US007543707B2

(12) United States Patent
Miler

(10) Patent No.: US 7,543,707 B2
(45) Date of Patent: Jun. 9, 2009

(54) WATER SOLUBLE CONTAINER

(75) Inventor: Fabienne Miler, Brimington (GB)

(73) Assignee: Reckitt Benckiser (UK) Limited, Berkshire (GB)

( * ) Notice: Subject to any disclaimer, the term of this patent is extended or adjusted under 35 U.S.C. 154(b) by 249 days.

(21) Appl. No.: 10/557,298

(22) PCT Filed: May 18, 2004

(86) PCT No.: PCT/GB2004/002149

§ 371 (c)(1),
(2), (4) Date: Mar. 8, 2006

(87) PCT Pub. No.: WO2004/103849

PCT Pub. Date: Dec. 2, 2004

(65) Prior Publication Data

US 2006/0219579 A1 Oct. 5, 2006

(30) Foreign Application Priority Data

May 20, 2003 (GB) ..... 0311503.7

(51) Int. Cl.
*B65D 85/84* (2006.01)
*B65D 25/08* (2006.01)
*C11D 17/00* (2006.01)

(52) U.S. Cl. ..... 206/524.7; 206/221; 510/296; 510/439

(58) Field of Classification Search ..... 206/219, 206/221, 524.1, 524.2, 524.4–7, 568; 510/296, 510/297, 406, 439, 220
See application file for complete search history.

(56) References Cited

U.S. PATENT DOCUMENTS

| | | | | |
|---|---|---|---|---|
| 4,210,139 | A * | 7/1980 | Higuchi | 424/436 |
| 5,224,601 | A * | 7/1993 | Gouge et al. | 206/524.7 |
| 5,474,784 | A * | 12/1995 | Stevens et al. | 424/456 |
| 2004/0118711 | A1* | 6/2004 | Duffield | 206/219 |
| 2004/0118738 | A1* | 6/2004 | Guzmann et al. | 206/524.7 |
| 2005/0261155 | A1* | 11/2005 | Wiedemann et al. | 510/295 |

FOREIGN PATENT DOCUMENTS

EP 518720 A 12/1992

(Continued)

OTHER PUBLICATIONS

International Search Report dated Aug. 6, 2004 for application PCT/GB2004/002149.

(Continued)

*Primary Examiner*—Mickey Yu
*Assistant Examiner*—Melissa L Lalli

(57) ABSTRACT

A filled water-soluble injection moulded container (1) containing a first composition (6) held in a first compartment (2) and a second composition (8) held in a second compartment (3), said first compartment (2) and said second compartment (3) being separated by a water-soluble barrier (4) having an opening (5) plugged by a plug (7) arranged such that when said container (1) is filled with said first composition (6) and said second composition (8), said first compartment (2) is filled through said opening (5) in said barrier (4), said barrier (4) is plugged with said plug (7), and subsequently said second compartment (3) is filled with said second composition (8) and said second compartment is sealed with a closure part (9).

13 Claims, 1 Drawing Sheet

FOREIGN PATENT DOCUMENTS

| | | | |
|---|---|---|---|
| EP | 694059 | A | 11/1994 |
| GB | 2244258 | A | 11/1991 |
| GB | 2374581 | A | 10/2002 |
| WO | WO 89/12587 | | 12/1989 |
| WO | WO 92/17382 | | 10/1992 |
| WO | WO 94/09743 | A | 5/1994 |
| WO | WO 99/06522 | | 2/1999 |
| WO | WO 01/36290 | | 5/2001 |
| WO | WO 02/085737 | A1 | 10/2002 |
| WO | WO 02/085738 | A | 10/2002 |
| WO | WO 02/092456 | A | 11/2002 |
| WO | WO 03/016165 | A1 | 2/2003 |
| WO | WO 03/072694 | A | 9/2003 |

OTHER PUBLICATIONS

Written Opinion for application PCT/GB2004/002149.
Combined Search and Examination Report from The Patent Office in Great Britain dated Oct. 10, 2003 for application GB 0311503.7.

* cited by examiner

WATER SOLUBLE CONTAINER

FIELD OF THE INVENTION

The present invention relates to a water-soluble container which, when filled, contains at least two compositions.

BACKGROUND OF THE INVENTION

It is known to package chemical compositions, particularly those which may be of a hazardous or irritant nature, in water-soluble packages. Such packages may be made by folding or thermoforming one or more water-soluble films, as disclosed in WO 89/12587 and WO 92/17382, or may be formed by injection moulding a water-soluble composition, as disclosed in WO 01/36290.

Known injection moulded containers can contain one or two or more compositions. For example, WO 01/36290 discloses a water-soluble container having one or more compartments separated by vertical walls, the whole container being sealed by a single water-soluble film heat sealed over the opening of all of the compartments. A disadvantage of this arrangement is that it does not allow for the contents of the compartments to be delivered into a larger volume of water at different times. The film is the first part of the container to dissolve in water, leading to simultaneous opening of all of the compartments. Thus release of different compositions at different times is not possible.

WO 02/092456 and WO 02/085737 disclose a water-soluble container which can release different compositions at different times. The container comprises a member having at least two openings positioned on different sides if the member, each opening being closed by a film. By ensuring that the member is divided into at least two compartments and by ensuring that each compartment is closed by films having different dissolution properties from each other, it is possible to ensure that compositions are released at different times from each other when the container is placed in a large volume of water. A disadvantage of this arrangement is that the filling process is complex. One of the compartments is first filled through an uppermost opening with a composition and then sealed with a film. The container must then be turned over such that another opening is uppermost, and the process repeated using a second film. Such a process involves the manipulation of partially filled containers; turning them over leads to an increased risk of spillage as well as to increased production costs. It also involves the use of two different sealing films, again leading to increased complexity and costs. Furthermore the shape of the container is constrained by the requirement that it has at least two openings on different sides with flanges such that films can be sealed over the openings. Multiple flanges may lead to a product which is considered by consumers to be unattractive.

SUMMARY OF THE INVENTION

The present invention provides a water-soluble container which comprises at least two compartments containing compositions which can be released at different times which overcomes or alleviates at least one of the above problems.

The present invention provides a filled water-soluble injection moulded container containing a first composition held in a first compartment and a second composition held in a second compartment, said first compartment and said second compartment being separated by a water-soluble barrier having an opening plugged by a plug arranged such that when said container is filled with said first composition and said second composition, said first compartment is filled through said opening in said barrier, said barrier is plugged with said plug, and subsequently said second compartment is filled with said second composition and said second compartment is sealed with a closure part.

The present invention additionally provides an unfilled water-soluble injection moulded container containing a first compartment and a second compartment, said first compartment and said second compartment being separated by a water-soluble barrier having an opening arranged such that when said container is to be filled said first compartment is arranged to be filled through said opening in said barrier, said barrier capable of being plugged with a plug, and said second compartment is arranged to be filled through another opening in the container.

The present invention also provides a process for preparing a filled container as defined above which comprises providing an unfilled water-soluble injection moulded container as defined above, filling said first compartment with said first composition through said opening in said barrier, plugging said opening with a plug, filling said second compartment and sealing said second compartment with a closure part.

The term "water-soluble" when used herein means that when used in a washing machine, such as a laundry or dish washing machine, the water soluble aspects of the article are substantially (greater than 70%, ideally greater than 85%, and especially about 100%) dissolved or dispersed into the water. This can be tested by placing the article in 10 litres of agitated water at a desired temperature, for example 45° C., for 40 minutes and measuring any undissolved or non-disintegrated pieces of the parts of the article, which are water-soluble, that are left.

The filled container of the present invention is capable of releasing the compositions contained within it at different times when the container is placed in a large volume of water due to the different boundaries of the compartments. The second compartment is generally sealed with a water-soluble film, while the remainder of the container is injection moulded. An injection moulded wall is generally thicker than a film since it is not easily possible to manufacture injection moulded walls which are as thin as films. Hence the injection moulded parts of the container generally dissolve slower than the film. The first compartment is surrounded by injection moulded walls whereas the second compartment has at least one opening to the outside sealed by a film. This film is generally the first to dissolve, thus releasing the second composition from the second compartment into the outside environment. After a time the first composition is released from the first compartment. This release can be achieved in a number of different ways. For example the outside injection moulded walls can dissolve. This can result in a rapid release of the first composition at a particular time. Another possibility is that the plug dissolves or is removed, releasing the first composition through the opening in the barrier. This can result in a sustained release of the first composition as it gradually exits through the opening. Of course, a combination of these release methods can also be used.

The container of the present invention can also easily be filled without recourse to complex processing arrangements since it does not generally need to be rotated during the filling operation.

BRIEF DESCRIPTION OF THE DRAWING

The advantages of the present invention can easily be seen from an exemplary embodiment shown in the Figures.

DESCRIPTION OF THE INVENTION

Figure 1:
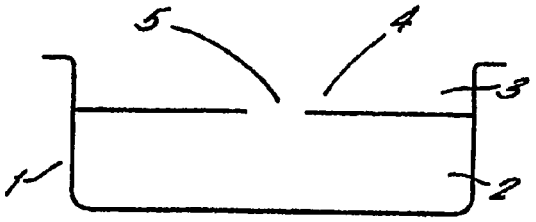
FIG. 1 is a cross section of an unfilled injection moulded container.

The unfilled container is made from a water-soluble (which term is taken to include water dispersible) material such as a water-soluble polymer. Examples of water-soluble polymers are poly(vinyl alcohol) (PVOH), cellulose derivatives such as hydroxypropyl methyl cellulose (HPMC), gelatin, poly(vinylpyrrolidone), poly(acrylic acid) or an ester thereof or poly (maleic acid) or an ester thereof. Copolymers of any of these polymers may also be used. An example of a preferred PVOH is esterified or etherified PVOH. The PVOH may be partially or fully alcoholized or hydrolyzed. For example it may be from 40 to 100%, preferably from 70 to 92%, more preferably about 88% or about 92%, alcoholised or hydrolyzed. The degree of hydrolysis is known to influence the temperature at which the PVOH starts to dissolve in water. 88% hydrolysis corresponds to a PVOH soluble in cold (i.e. room temperature) water, whereas 92% hydrolysis corresponds to a PVOH soluble in warm water. A preferred PVOH which can be further processed is sold in the form of granules under the name CP1210T05 by Soltec Developement SA of Paris, France.

By choosing an appropriate polymer it is possible to ensure that the water-soluble polymer dissolves at a desired temperature. Thus each the polymer may be cold water (20° C.) soluble, but may be insoluble in cold water and only become soluble in warm or hot water having a temperature of, for example, 30° C., 40° C., 50° C. or even 60° C. Desirably the injection moulded container, excluding its contents, consists essentially of, or consists of, the water-soluble polymer composition. It is possible for suitable additives such as plasticisers, lubricants and colouring agents to be added. Components which modify the properties of the polymer may also be added. Plasticisers are generally used in an amount of up to 20 wt %, for example from 10 to 20 wt %. Lubricants are generally used in an amount of 0.5 to 5 wt %. The polymer is therefore generally used in an amount of from 75 to 84.5 wt %, based on the total amount of the moulding composition. Suitable plasticisers are, for example, pentaerythritols such as depentaerythritol, sorbitol, mannitol, glycerine and glycols such as glycerol, ethylene glycol and polyethylene glycol. Solids such as talc, stearic acid, magnesium stearate, silicon dioxide, zinc stearate or colloidal silica may be used as lubricants.

It is also possible to include one or more particulate solids in the moulding composition from which the containers are formed in order to accelerate the rate of dissolution of the film. Dissolution of the solid in water is sufficient to cause an acceleration in the break-up of the film, particularly if a gas is generated.

Examples of such solids are alkali and alkaline earth metal, such as sodium, potassium, magnesium and calcium, bicarbonate and carbonate, in conjunction with an acid. Suitable acids are, for example acidic substances having carboxylic or sulfonic acid groups or salts thereof. Examples are cinnamic, tartaric, mandelic, fumaric, maleic, malic, palmoic, citric and naphthalene disulfonic acids, as free acids or as their salts, for example with alkali or alkaline earth metals.

The walls of the container and the barrier generally have thicknesses of greater than 50 μm, for example greater than 100 μm, 150 μm, 200 μm, 300 μm, 500 μm, 750 μm or even 1 mm. The barrier may be thinner, the same thickness or thicker than the outer walls of the container depending on the dissolution characteristics desired.

The closure part, especially when it is in the form of a film, may be placed on top of the filled container, and desirably across a sealing portion such as a flange if it is present, and is sealed to the container. This film may be a single-layered film but is desirably laminated to reduce the possibility of pinholes allowing leakage through the film. The film may be made of the same or different material as the material forming the injection moulded container.

When the closure part is in the form of a film it may be produced by any process, for example by extrusion and blowing or by casting. The film may be unoriented, monoaxially oriented or biaxially oriented. If the layers in the film are oriented, they usually have the same orientation, although their planes of orientation may be different if desired. The film may be a single film, or a laminated film as disclosed in GB-A-2,244,258. The layers in a film laminate may be the same or different. Thus they may each comprise the same polymer or a different polymer.

Desirably the closure part, especially when it is in the form of a film, has a thickness which is less than that of the walls of the container in order to allow for the correct dissolution of the compositions held within the container. However, control over the relative dissolution times of the film and the injection moulded container can also be exercised by choosing materials with different dissolution characteristics, for example PVOH with different degrees of hydrolysis, or by coating the closure part or walls of the container with a composite which retards dissolution.

The thickness of the closure part, especially when in the form of a film, is generally from 20 to 160 μm, preferably from 40 to 100 μm, such as 40 to 80 μm or 50 to 60 μm.

The closure part and the injection moulded container are sealed together in a known manner. For example, heat sealing can be used, as well as other sealing methods such as infrared, radio-frequency, ultrasonic, laser or solvent welding, for example using water or a solution of the polymer from which the container and/or closure part is formed.

Heat sealing conditions depend on the machine and material used. Generally the sealing temperature is from 100 to 180° C. The pressure is usually from 10 to 500 kPa (1 to 5 bar). The dwell time is generally from 1.3 to 2.5 seconds.

Preferably the closure part dissolves in water first to allow the composition held in the second compartment to be released first. It is, for example, desirable for the composition held in the second compartment to be released in less than 5 minutes, preferably less than 2 minutes, when the container is placed in water at 40° C.

Preferably the container of the present invention is manufactured by forming an array of individual containers, each container being joined to adjacent containers and being severable from them by a snap or tear action. The array is preferably one with columns and rows of containers. The containers may be separated by frangible webs of the water-soluble polymer of which they are made. The containers may be manufactured with flanges such that they are separated from each other by a line of weakness. For example the material may be thinner and so be able to be broken or torn easily. The thinness may be as a result of the moulding process or, preferably, of a later scoring step.

Once the containers have been filled and the closure part applied, the array may be split into individual containers prior to packaging or it may be left as an array to be split by the user.

As well as having the barrier separating the first and second compartments, the containers of the present invention may also comprise further internal walls splitting the first compartment and/or the second compartment into sub-compartments to contain different compositions. Such further internal walls are generally perpendicular to the barrier. The container may also comprise further compartments.

Preferably the barrier is orientated such that the plug locates itself across the opening, for example by use of a gradient towards the opening.

The container may be formed with an opening, for example a depression formed in a side wall or the base wall, and preferably being open in the outward direction. Preferably the opening is adapted to receive, in a press-fit manner, a solid block, for example a tablet, of a composition, for example a composition useful in a washing process. It is also possible to fill the opening with a liquid which subsequently forms a gel.

The water-soluble container produced by the process of the present invention contains at least two compositions, which may be the same or different.

The compositions in the first and second compartments, or in any further compartments or sub-compartments, may be the same or different, although they are usually different. They may have the same or different physical states. Thus both, or all, of the compositions may be, for example, liquid, particulate, granular, gelled, or solid. Another possibility is that one of the compositions is liquid and the other is not a liquid, for example it is particulate, granular, gelled or solid.

The plug may have any form and be of any composition so long as it fulfils the function of plugging the opening such that the contents of the first and second compartments do not mix. This is especially important when one of these is a liquid. Desirable the plug is of a size and shape such that is can easily plug the opening in a high-speed manufacturing process. Thus, for example, the plug can be in the form of a sphere or ball. The plug can then simply be placed on top of the barrier near the opening, and it will roll into place in the opening even if it is not precisely positioned. In order to assist this process the containers may be vibrated, or the barrier may be slightly inclined towards the opening, for example by 2 to 20°, especially 5 to 10°.

The plug can also have a flat or planer shape, in which case it is simply placed above the opening to cover it.

The plug can simply plug the opening unassisted if desired. The pressure of the compositions in the compartments either side of the barrier may be sufficient to ensure that it stays in place. It is also possible to take further steps to ensure that the plug stays in place, for example by adhering it to the barrier around the opening.

The plug may have any composition, although it is desirably water-soluble. It may be inert and simply dissolve or disperse in water. Desirably, however, it has a useful function in addition to acting as a plug. Thus it may, for example, comprises a composition useful in washing or detergency. It may, for example, comprise a fabric care, surface care or dishwashing composition, for example a laundry, water-softening or rinse and composition or a bleach or bleach enhancer composition.

The plug may dissolve at any desired time depending on its function. Thus, for example, if it comprises a rise aid it preferably dissolves after all the other compositions held in the container.

The plug to the opening may be formed from the first composition. For example, the first composition may be a setting liquid or may be a highly viscous liquid or a liquid that forms a phase barrier with the second composition.

The containers may contain one or more than one composition. If the containers contain two or more different compositions, they can have a particularly attractive appearance since the compositions, may be held in a fixed position in relation to each other.

The compositions can be easily differentiated to accentuate their difference. For example, the compositions can have a different physical appearance, or can be coloured differently.

The compositions within the compartments need not be uniform. For example, during manufacture the first compartment could be filled with a settable composition, for example, a gel, and the second compartment filled with a compacted particulate composition. One of these compositions could dissolve slowly in the washing process so as to deliver its charge over a long period within the washing process. This might be useful, for example, to provide an immediate, delayed or sustained delivery of a component such as a softening agent.

The compositions which can be held in the container may independently be a fabric care, surface care or dishwashing composition. Thus, for example, they may be a dishwashing, water-softening, laundry or detergent composition, or a rinse aid. Such compositions may be suitable for use in a domestic washing machine. The compositions may also independently be a disinfectant, antibacterial or antiseptic composition, or a refill composition for a trigger-type spray. Such compositions are generally packaged in total amounts of from 5 to 100 g, especially from 15 to 40 g. For example, a laundry composition may weigh from 15 to 40 g, a dishwashing composition may weigh from 15 to 30 g and a water-softening composition may weigh from 15 to 40 g.

The containers may have any desired shape. For example the containers can have a irregular or regular geometrical shape such as a cube, cuboid, pyramid, dodecahedron or cylinder. The cylinder may have any desired cross-section, such as a circular, triangular or square cross-section.

The individual compartments need not necessarily be regular or identical. For example, if the final container has a cuboid shape, the individual compartments may have different sizes or shapes to accommodate different quantities of compositions. In general, the compartments have volume ratios of from 10:1 to 1:10, especially from 2:1 to 1:2.

In a preferred aspect of the present invention the first compartment is defined by a lower surface, the barrier and walls extending therebetween, the lower surface and the barrier being substantially parallel. Additionally, or as a separate aspect in the second compartment is defined by an opening, the barrier and walls extending therebetween, the opening and the barrier being substantially parallel.

The container may also have a hook portion so that it can be hung, for example, from an appropriate place inside a dishwashing machine.

The packages produced by the process of the present invention may, if desired, have a maximum dimension of 5 cm, excluding any flanges. For example, a container may have a length of 1 to 5 cm, especially 3.5 to 4.5 cm, a width of 1.5 to 3.5 cm, especially 2 to 3 cm, and a height of 1 to 2 cm, especially 1.25 to 1.75 cm.

If more than one composition is present, the compositions may be appropriately chosen depending on the desired use of the article.

If the container is for use in laundry washing, the composition in each compartment may comprise, for example, a detergent, and the plug may comprise a bleach, stain remover, water-softener, enzyme or fabric conditioner. The container is adapted to release the compositions at different times during the laundry wash. For example, a bleach or fabric conditioner is generally released at the end of a wash, and a water-softener is generally released at the start of a wash. An enzyme may be released at the start or the end of a wash.

If the container article is for use as a fabric conditioner, the compositions in each compartment may comprise a fabric conditioner and the plug may comprise an enzyme which is released before or after the fabric conditioner in a rinse cycle.

If the container is for use in dishwashing the compositions in each compartment may comprise a detergent and the plug may comprise a water-softener, salt, enzyme, rinse aid, bleach or bleach activator. The container is adapted to release the compositions at different times during the laundry wash. For example, a rinse aid, bleach or bleach activator is generally released at the end of a wash, and a water-softener, salt or enzyme is generally released at the start of a wash.

Examples of surface care compositions are those used in the field of surface care, for example to clean, treat or polish a surface. Suitable surfaces are, for example, household surfaces such as worktops, as well as surfaces of sanitary ware, such as sinks, basins and lavatories.

The ingredients of each composition depend on the use of the composition. Thus, for example, the composition may contain surface active agents such as an anionic, non-ionic, cationic, amphoteric or zwitterionic surface active agents or mixtures thereof.

Examples of anionic surfactants are straight-chained or branched alkyl sulfates and alkyl polyalkoxylated sulfates, also known as alkyl ether sulfates. Such surfactants may be produced by the sulfation of higher $C_8$-$C_{20}$ fatty alcohols. Examples of primary alkyl sulfate surfactants are those of formula:

$$ROSO_3^-M^+$$

wherein R is a linear $C_8$-$C_{20}$ hydrocarbyl group and M is a water-solubilising cation. Preferably R is $C_{10}$-$C_{16}$ alkyl, for example $C_{12}$-$C_{14}$, and M is alkali metal such as lithium, sodium or potassium.

Examples of secondary alkyl sulfate surfactants are those which have the sulfate moiety on a "backbone" of the molecule, for example those of formula:

$$CH_2(CH_2)_n(CHOSO_3^-M^+)(CH_2)_mCH_3$$

wherein m and n are independently 2 or more, the sum of m+n typically being 6 to 20, for example 9 to 15, and M is a water-solubilising cation such as lithium, sodium or potassium.

Especially preferred secondary alkyl sulfates are the (2,3) alkyl sulfate surfactants of formulae:

$$CH_2(CH_2)_x(CHOSO_3^-M^+)CH_3 \text{ and}$$

$$CH_3(CH_2)_x(CHOSO_3^-M^+)CH_2CH_3$$

for the 2-sulfate and 3-sulfate, respectively. In these formulae x is at least 4, for example 6 to 20, preferably 10 to 16. M is cation, such as an alkali metal, for example lithium, sodium or potassium.

Examples of alkoxylated alkyl sulfates are ethoxylated alkyl sulfates of the formula:

$$RO(C_2H_4O)_nSO_3^-M^+$$

wherein R is a $C_8$-$C_{20}$ alkyl group, preferably $C_{10}$-$C_{18}$ such as a $C_{12}$-$C_{16}$, n is at least 1, for example from 1 to 20, preferably 1 to 15, especially 1 to 6, and M is a salt-forming cation such as lithium, sodium, potassium, ammonium, alkylammonium or alkanolammonium. These compounds can provide especially desirable fabric cleaning performance benefits when used in combination with alkyl sulfates.

The alkyl sulfates and alkyl ether sulfates will generally be used in the form of mixtures comprising varying alkyl chain lengths and, if present, varying degrees of alkoxylation.

Other anionic surfactants which may be employed are salts of fatty acids, for example $C_8$-$C_{18}$ fatty acids, especially the sodium or potassium salts, and alkyl, for example $C_8$-$C_{18}$, benzene sulfonates.

Examples of non-ionic surfactants are fatty acid alkoxylates, such as fatty acid ethoxylates, especially those of formula:

$$R(C_2H_4O)_nOH$$

wherein R is a straight or branched $C_8$-$C_{16}$ alkyl group, preferably a $C_9$-$C_{15}$, for example $C_{10}$-$C_{14}$, alkyl group and n is at least 1, for example from 1 to 16, preferably 2 to 12, more preferably 3 to 10.

The alkoxylated fatty alcohol non-ionic surfactant will frequently have a hydrophilic-lipophilic balance (HLB) which ranges from 3 to 17, more preferably from 6 to 15, most preferably from 10 to 15.

Examples of fatty alcohol ethoxylates are those made from alcohols of 12 to 15 carbon atoms and which contain about 7 moles of ethylene oxide. Such materials are commercially marketed under the trademarks Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$-$C_{13}$ alcohol having about 9 moles of ethylene oxide; and Neodol 91-10, an ethoxylated $C_9$-$C_{11}$ primary alcohol having about 10 moles of ethylene oxide.

Alcohol ethoxylates of this type have also been marketed by Shell Chemical Company under the Dobanol trademark. Dobanol 91-5 is an ethoxylated $C_9$-$C_{11}$ fatty alcohol with an average of 5 moles ethylene oxide and Dobanol 25-7 is an ethoxylated $C_{12}$-$C_{15}$ fatty alcohol with an average of 7 moles of ethylene oxide per mole of fatty alcohol.

Other examples of suitable ethoxylated alcohol non-ionic surfactants include Tergitol 15-S-7 and Tergitol 15-S-9, both of which are linear secondary alcohol ethoxylates available from Union Carbide Corporation. Tergitol 15-S-7 is a mixed ethoxylated product of a $C_{11}$-$C_{15}$ linear secondary alkanol with 7 moles of ethylene oxide and Tergitol 15-S-9 is the same but with 9 moles of ethylene oxide.

Other suitable alcohol ethoxylated non-ionic surfactants are Neodol 45-11, which is a similar ethylene oxide condensation products of a fatty alcohol having 14-15 carbon atoms and the number of ethylene oxide groups per mole being about 11. Such products are also available from Shell Chemical Company.

Further non-ionic surfactants are, for example, $C_{10}$-$C_{18}$ alkyl polyglycosides, such s $C_{12}$-$C_{16}$ alkyl polyglycosides, especially the polyglucosides. These are especially useful when high foaming compositions are desired. Further surfactants are polyhydroxy fatty acid amides, such as $C_{10}$-$C_{18}$ N-(3-methoxypropyl) glycamides and ethylene oxide-propylene oxide block polymers of the Pluronic type.

Examples of cationic surfactants are those of the quaternary ammonium type.

The total content of surfactants in the composition is desirably 60 to 95 wt %, especially 75 to 90 wt %. Desirably an anionic surfactant is present in an amount of 50 to 75 wt %, the nonionic surfactant is present in an amount of 5 to 50 wt %, and/or the cationic surfactant is present in an amount of from 0 to 20 wt %. The amounts are based on the total solids content of the composition, i.e. excluding any solvent which may be present.

The compositions, particularly when used as laundry washing or dishwashing compositions, may also independently comprise enzymes, such as protease, lipase, amylase, cellulase and peroxidase enzymes. Such enzymes are commercially available and sold, for example, under the registered trade marks Esperase, Alcalase and Savinase by Nova Industries A/S and Maxatase by International Biosynthetics, Inc. Desirably the enzymes are independently present in the compositions in an amount of from 0.5 to 3 wt %, especially 1 to 2 wt %, when added as commercial preparations they are not pure and this represents an equivalent amount of 0.005 to 0.5 wt % of pure enzyme.

The compositions may, if desired, independently comprise a thickening agent or gelling agent. Suitable thickeners are polyacrylate polymers such as those sold under the trade mark CARBOPOL, or the trade mark ACUSOL by Rohm and Haas Company. Other suitable thickeners are xanthan gums. The thickener, if present, is generally present in an amount of from 0.2 to 4 wt %, especially 0.5 to 2 wt %.

Compositions used in dishwashing independently usually comprise a detergency builder. The builders counteract the effects of calcium, or other ion, water hardness. Examples of such materials are citrate, succinate, malonate, carboxymethyl succinate, carboxylate, polycarboxylate and polyacetyl carboxylate salts, for example with alkali metal or alkaline earth metal cations, or the corresponding free acids. Specific examples are sodium, potassium and lithium salts of oxydisuccinic acid, mellitic acid, benzene polycarboxylic acids, $C_{10}$-$C_{22}$ fatty acids and citric acid. Other examples are organic phosphonate type sequestering agents such as those sold by Monsanto under the trade mark Dequest and alkylhydroxy phosphonates. Citrate salts and $C_{12}$-$C_{18}$ fatty acid soaps are preferred. Further builders are; phosphates such as sodium, potassium or ammonium salts of mono-, di- or tripoly or oligo-phosphates; zeolites; silicates, amorphous or structured, such as sodium, potassium or ammonium salts.

Other suitable builders are polymers and copolymers known to have builder properties. For example, such materials include appropriate polyacrylic acid, polymaleic acid, and polyacrylic/polymaleic and copolymers and their salts, such as those sold by BASF under the trade mark Sokalan. The builder is desirably present-in an amount of up to 90 wt %, preferably 15 to 90 wt %, more preferable 15 to 75 wt %, relative to the total weight of the composition. Further details of suitable components are given in, for example, EP-A-694,059, EP-A-518,720 and WO 99/06522.

The compositions can also optionally comprise one or more additional ingredients. These include conventional detergent composition components such as further surfactants, bleaches, bleach enhancing agents, builders, suds boosters or suds suppressors, anti-tarnish and anti-corrosion agents, organic solvents, co-solvents, phase stabilisers, emulsifying agents, preservatives, soil suspending agents, soil release agents, germicides, pH adjusting agents or buffers, non-builder alkalinity sources, chelating agents, clays such as smectite clays, enzyme stabilizers, anti-limescale agents, colourants, dyes, hydrotropes, dye transfer inhibiting agents, brighteners, and perfumes. If used, such optional ingredients will generally constitute no more than 10 wt %, for example from 1 to 6 wt %, the total weight of the compositions.

Compositions which comprise an enzyme may optionally contain materials which maintain the stability of the enzyme. Such enzyme stabilizers include, for example, polyols such as propylene glycol, boric acid and borax. Combinations of these enzyme stabilizers may also be employed. If utilized, the enzyme stabilizers generally constitute from 0.1 to 1 wt % of the compositions.

The compositions may optionally comprise materials which serve as phase stabilizers and/or co-solvents. Examples are $C_1$-$C_3$ alcohols such as. methanol, ethanol and propanol. $C_1$-$C_3$ alkanolamines such as mono-, di- and triethanolamines can also be used, by themselves or in combination with the alcohols. The phase stabilizers and/or co-solvents can, for example, constitute 0 to 1 wt %, preferably 0.1 to 0.5 wt %, of the composition.

The compositions may optionally comprise components which adjust or maintain the pH of the compositions at optimum levels. The pH may be from, for example, 1 to 13, such as 8 to 11 depending on the nature of the composition. For example a dishwashing composition desirably has a pH of 8 to 11, a laundry composition desirable has a pH of 7 to 9, and a water-softening composition desirably has a pH of 7 to 9. Examples of pH adjusting agents are NaOH and citric acid.

The above examples may be used for dish or fabric washing. In particular dish washing formulations are preferred which are adapted to be used in automatic dish washing machines. Due to their specific requirements specialised formulation is required and these are illustrated below Amounts of the ingredients can vary within wide ranges, however preferred automatic dishwashing detergent compositions herein (which typically have a 1% aqueous solution pH of above 8, more preferably from 9.5 to 12, most preferably from 9.5 to 10.5) are those wherein there is present: from 5% to 90%, preferably from 5% to 75%, of builder; from 0.1% to 40%, preferably from 0.5% to 30%, of bleaching agent; from 0.1% to 15%, preferably from 0.2% to 10%, of the surfactant system; from 0.0001% to 1%, preferably from 0.001% to 0.05%, of a metal-containing bleach catalyst; and from 0.1% to 40%, preferably from 0.1% to 20% of a water-soluble silicate. Such fully-formulated embodiments typically further comprise from 0.1% to 15% of a polymeric dispersant, from 0.01% to 10% of a chelant, and from 0.00001% to 10% of a detersive enzyme, though further additional or adjunct ingredients may be present. Detergent compositions herein in granular form typically limit water content, for example to less than 7% free water, for better storage stability.

Non-ionic surfactants useful in ADW (Automatic Dish Washing) compositions of the present invention desirably include surfactant(s) at levels of from 2% to 60% of the composition. In general, bleach-stable surfactants are preferred. Non-ionic surfactants generally are well known, being described in more detail in Kirk Othmer's Encyclopedia of Chemical Technology, 3rd Ed., Vol. 22, pp. 360-379, "Surfactants and Detersive Systems", incorporated by reference herein.

Preferably the ADW composition comprises at least one non-ionic surfactant. One class of non-ionics are ethoxylated non-ionic surfactants prepared by the reaction of a monohydroxy alkanol or alkylphenol with 6 to 20 carbon atoms with preferably at least 12 moles particularly preferred at least 16 moles, and still more preferred at least 20 moles of ethylene oxide per mole of alcohol or alkylphenol.

Particularly preferred non-ionic surfactants are the non-ionic from a linear chain fatty alcohol with 16-20 carbon atoms and at least 12 moles particularly preferred at least 16 and still more preferred at least 20 moles of ethylene oxide per mole of alcohol.

According to one preferred embodiment the non-ionic surfactant additionally comprise propylene oxide units in the molecule. Preferably this PO units constitute up to 25% by weight, preferably up to 20% by weight and still more preferably up to 15% by weight of the overall molecular weight of the non-ionic surfactant. Particularly preferred surfactants are ethoxylated mono-hydroxy alkanols or alkylphenols, which additionally comprises polyoxyethylene-polyoxypropylene block copolymer units. The alcohol or alkylphenol portion of such surfactants constitutes more than 30%, preferably more than 50%, more preferably more than 70% by weight of the overall molecular weight of the non-ionic surfactant.

Another class of non-ionic surfactants includes reverse block copolymers of polyoxyethylene and polyoxypropylene and block copolymers of polyoxyethylene and polyoxypropylene initiated with trimethylolpropane.

Another preferred non-ionic surfactant can be described by the formula:

$$R^1O[CH_2CH(CH_3)O]_x[CH_2CH_2O]_y[CH_2CH(OH)R^2]$$

wherein $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]_x[CH_2]_kCH(OH)[CH_2]_jOR^2$$

wherein $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group , x is a value between 1 and 30 and, k and j are values between 1 and 12, preferably between 1 and 5. When the value of x is $\geqq 2$ each $R^3$ in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3H$, methyl or ethyl are particularly preferred. Particularly preferred values for x are comprised between 1 and 20, preferably between 6 and 15.

As described above, in case $x \geqq 2$, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH\ (R^3)O]_xCH_2CH(OH)CH_2OR^2$$

The use of mixtures of different non-ionic surfactants is particularly preferred in ADW formulations for example mixtures of alkoxylated alcohols and hydroxy group containing alkoxylated alcohols.

The containers may themselves be packaged in outer containers if desired, for example non-water soluble containers which are removed before the water-soluble containers are used.

In use one or more containers are simply added to water where the outside dissolves. Thus they may be added in the usual way to a dishwasher or laundry machine, especially in the dishwashing compartment or a drum. They may also be added to a quantity of water, for example in a bucket or trigger-type spray.

An embodiment of the present invention is now further illustrated using the attached Figures.

FIG. 1 shows an unfilled container (1) of the present invention comprising a first compartment (2) and a second compartment (3) being separated by a water-soluble barrier (4) having an opening (5). The container (1) is integrally formed.

The container (1) is generally cuboid. The first compartment (2) is defined by a lower surface, the barrier (4) and walls extending therebetween. The lower surface and the barrier (4) are substantially parallel, in that they do not converge by more than 10°, preferably by not more than 5°. The second compartment (3) is defined by an opening (itself defined by the perimeter of the container), the barrier (4) and walls extending therebetween. The opening and the barrier are substantially parallel, in that they do not converge by more than 10°, preferably by not more than 5°.

Figure 2:
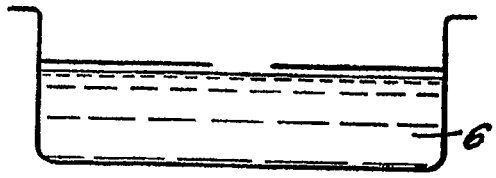
FIG. 2 shows the container in which the first compartment is filled with a first composition.

FIG. 2 shows that the container of FIG. 1 in which the first compartment (2) has been filled with a first composition (6) through the opening (5).

Figure 3:
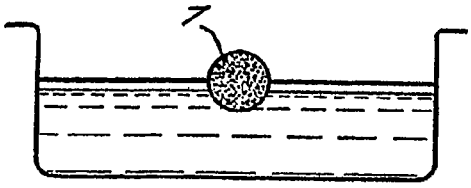
FIG. 3 shows the container in which the barrier opening has been sealed by a plug.

FIG. 3 shows the container of FIG. 2 in which the opening (5) has been plugged with a spherical plug (7).

Figure 4:
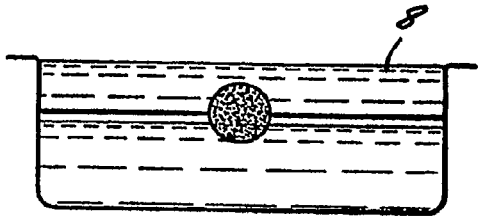
FIG. 4 shows the container in which the second compartment is filled with a second composition.

FIG. 4 shows the container of FIG. 4 in which the second compartment (3) has been filled with a second composition (8).

Figure 5:
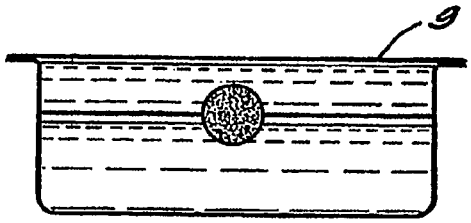
FIG. 5 shows the container in which the second compartment has been sealed.

FIG. 5 shows the container of FIG. 4 which has been sealed with a film (9). The film (9) is heat-sealed, for example, to the flanges of the container (1).

The invention claimed is:

1. A method for preparing a filled water-soluble injection molded container (1), said container comprising a first composition (6) held in a first compartment (2) and a second composition (8) held in a second compartment(3), said first compartment and said second compartment being separated by a water-soluble barrier (4) having an opening (5) plugged by a plug (7) arranged such that when said container is filled which method comprises the steps of: providing an unfilled water-soluble injection moulded container (1) filling said first compartment (2) with said first composition (6) through said opening (5) in said barrier (4), plugging said opening (5) with a plug (7), filling said second compartment (3) with said second composition (8) and sealing said second compartment (3) with a closure part (9).

2. A method according to claim 1 wherein said closure part (9) is a water-soluble film (9).

3. A method according to claim 1 wherein said plug (7) comprises a water-soluble composition.

4. A method according to claim 1 wherein said plug (7) is spherical.

5. A method according to claim 1 wherein said first composition (6) and said second composition (8) are each a fabric care, surface care or dishwashing composition.

6. A method according to claim 5 wherein said first composition (6) and said second composition (8) are each a dishwashing, water-softening, laundry, detergent or rinse aid composition.

7. A method according to claim 1 wherein said first composition (6) and said second composition (8) are each a disinfectant, antibacterial or antiseptic composition.

8. A method according to claim 1 wherein said first composition and said second composition are each an agricultural composition.

9. A method according to claim 1 wherein said container is made from a poly(vinyl alcohol) (PVOH).

10. A method according to claim 1 wherein said first compartment (2) is defined by a lower surface, said barrier (4) and walls extending therebetween, said lower surface and said barrier (4) being substantially parallel.

11. A method according to claim 1 wherein said second compartment (3) is defined by an opening, said barrier (4) and walls extending therebetween.

12. A method according to claim 1 which is cuboid.

13. A method according to claim 2 wherein said plug (7) comprises a water-soluble composition.

* * * * *